US011383358B1

(12) United States Patent
Liaw

(10) Patent No.: US 11,383,358 B1
(45) Date of Patent: Jul. 12, 2022

(54) WRENCH

(71) Applicant: TAGATEC Industrial., Ltd., Taichung (TW)

(72) Inventor: Jian-Shiou Liaw, Taichung (TW)

(73) Assignee: TAGATEC INDUSTRIAL., LTD., Taichung (TW)

( * ) Notice: Subject to any disclaimer, the term of this patent is extended or adjusted under 35 U.S.C. 154(b) by 0 days.

(21) Appl. No.: 17/244,431

(22) Filed: Apr. 29, 2021

(51) Int. Cl.
*B25B 13/06* (2006.01)
*B25B 23/00* (2006.01)

(52) U.S. Cl.
CPC ..... *B25B 13/06* (2013.01); *B25B 23/0028* (2013.01)

(58) Field of Classification Search
CPC ... B25B 13/06; B25B 23/0028; B25B 13/066; B25G 1/066
USPC ..... 81/177.75, 177.8, 177.9, 177.1, 177.2
See application file for complete search history.

(56) References Cited

U.S. PATENT DOCUMENTS 2,886,998 A * 5/1959 Scott ..... B25B 13/08 81/177.9
4,711,145 A * 12/1987 Inoue ..... B25G 1/063 81/177.1
5,419,221 A * 5/1995 Cole ..... B25B 13/461 81/177.8
5,860,337 A * 1/1999 Janssen ..... B25G 1/063 81/63
7,987,749 B2 * 8/2011 Hsieh ..... B25G 1/063 81/177.8
8,646,365 B2 * 2/2014 Hsieh ..... B25G 1/063 81/177.8
9,975,222 B2 * 5/2018 Yang ..... B25B 13/463
11,241,772 B1 * 2/2022 Roche ..... B25B 13/06
11,247,315 B2 * 2/2022 MacDonald ..... B25B 23/0035
2004/0206213 A1 * 10/2004 Hsien ..... B25G 1/105 81/125.1
2004/0261586 A1 * 12/2004 Chen ..... B25G 1/063 81/177.7
2006/0201288 A1 * 9/2006 Chen ..... B25B 13/461 81/177.8
2010/0307297 A1 * 12/2010 Chiang ..... B25B 13/466 81/63.1
2011/0232424 A1 * 9/2011 Chang ..... B25B 13/461 81/177.1
2014/0230611 A1 * 8/2014 Liu ..... B25B 13/06 81/124.7
2021/0187710 A1 * 6/2021 Winnard ..... F16C 11/04
2022/0009062 A1 * 1/2022 Yang ..... B25B 13/04
2022/0080563 A1 * 3/2022 Kuzmic ..... B25B 23/0035

FOREIGN PATENT DOCUMENTS

TW M588608 U 1/2020
TW M605149 U 12/2020
TW I716192 B 1/2021

* cited by examiner

*Primary Examiner* — Orlando E Aviles
*Assistant Examiner* — Jason Khalil Hawkins
(74) *Attorney, Agent, or Firm* — Muncy, Geissler, Olds & Lowe, P.C.

(57) ABSTRACT

A wrench is provided, including: a rod member; and a driving member, rotatably connected to the rod member, including an insertion hole disposed therethrough, the insertion hole being configured for a connector to be replaceably inserted therewithin.

9 Claims, 6 Drawing Sheets

WRENCH

BACKGROUND OF THE INVENTION

Field of the Invention

The present invention relates to a wrench.

Description of the Prior Art

A wrench is a common type of hand tool in the manufacturing industry. It is often used to turn bolts, nuts or other fasteners. There are various types of wrenches respectively for various types of fasteners or for various usage needs. For example, there are conventional types of wrenches, such as open-ended wrenches, torx wrenches, adjustable wrenches, ratchet wrenches, or the wrenches disclosed in TWM605149, TW1716192 and TWM588608.

However, in the conventional types of wrenches, the rod member and the driving member cannot relatively swing, so more space is required for the rod member to sufficiently rotate, and the position of the rod member is limited by the surrounding environment or interfered by obstacles.

The present invention is, therefore, arisen to obviate or at least mitigate the above-mentioned disadvantages.

SUMMARY OF THE INVENTION

The main object of the present invention is to provide a wrench which is operable in various use angles to meet requirements in different environments and compatible with various fasteners.

To achieve the above and other objects, the present invention provides a wrench, including: a rod member; and a driving member, rotatably connected to the rod member, including an insertion hole disposed therethrough, the insertion hole being configured for a connector to be replaceably inserted therewithin.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
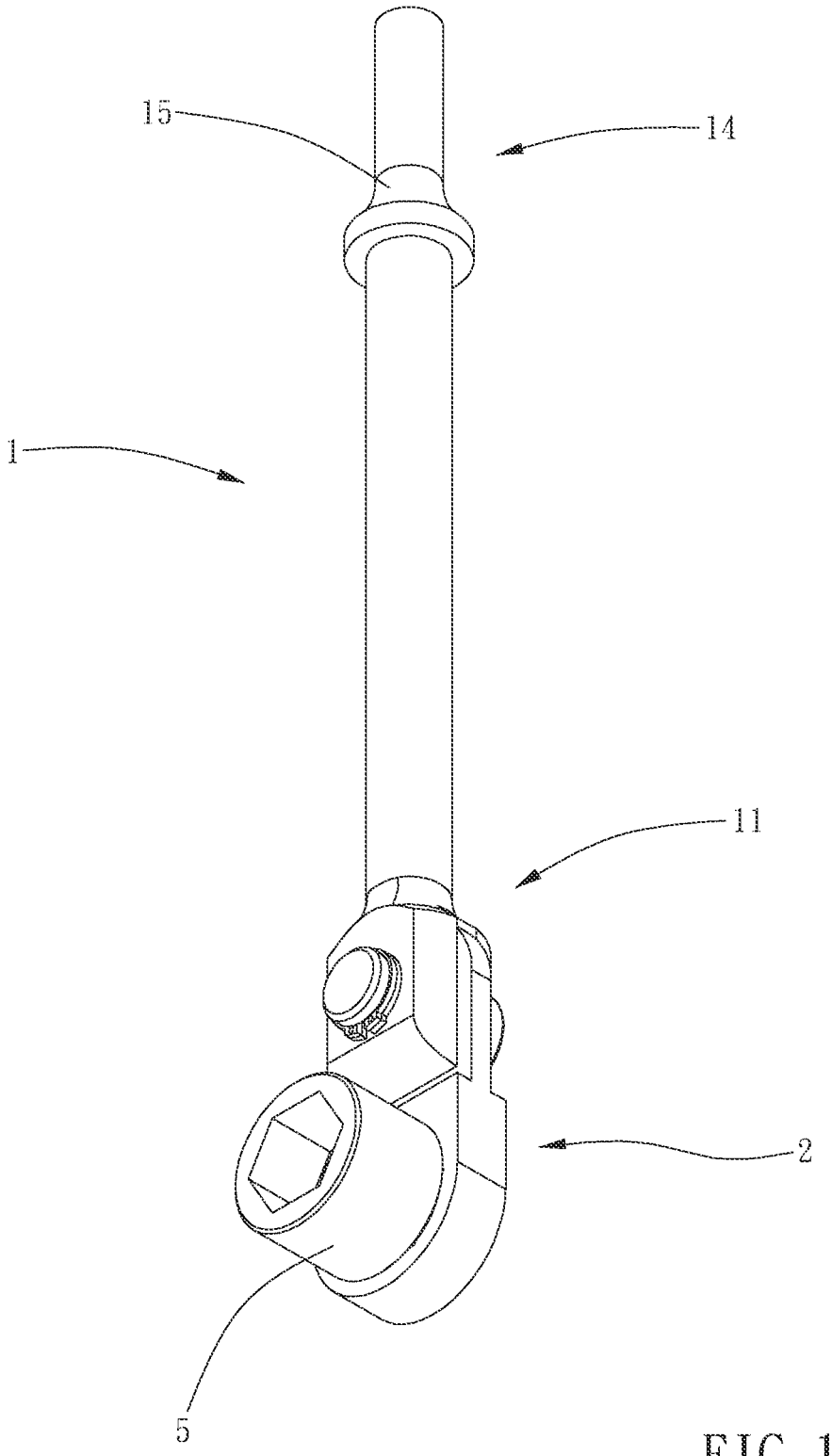
FIG. 1 is a stereogram of a preferable embodiment of the present invention.
Figure 2:
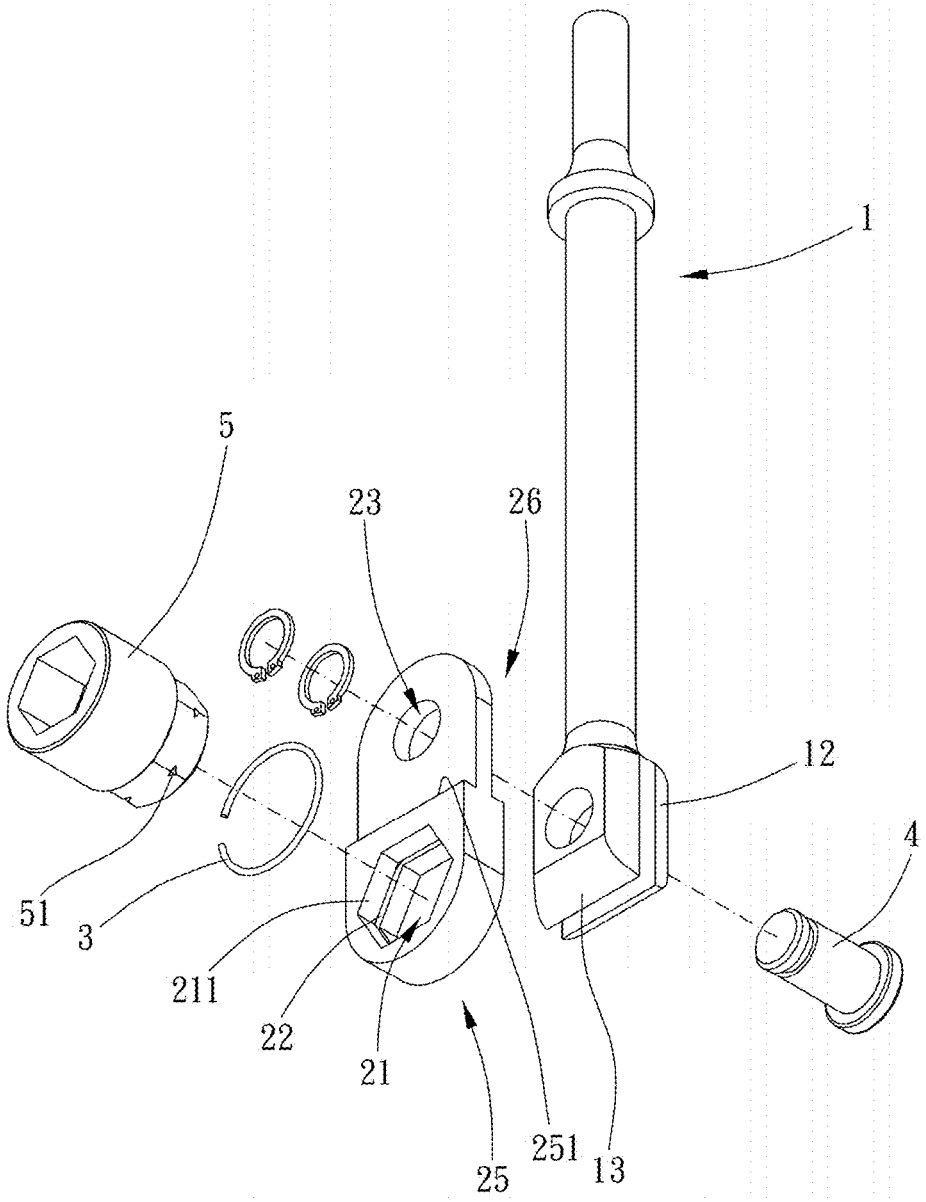
FIG. 2 is a breakdown drawing of a preferable embodiment of the present invention.
Figure 3:
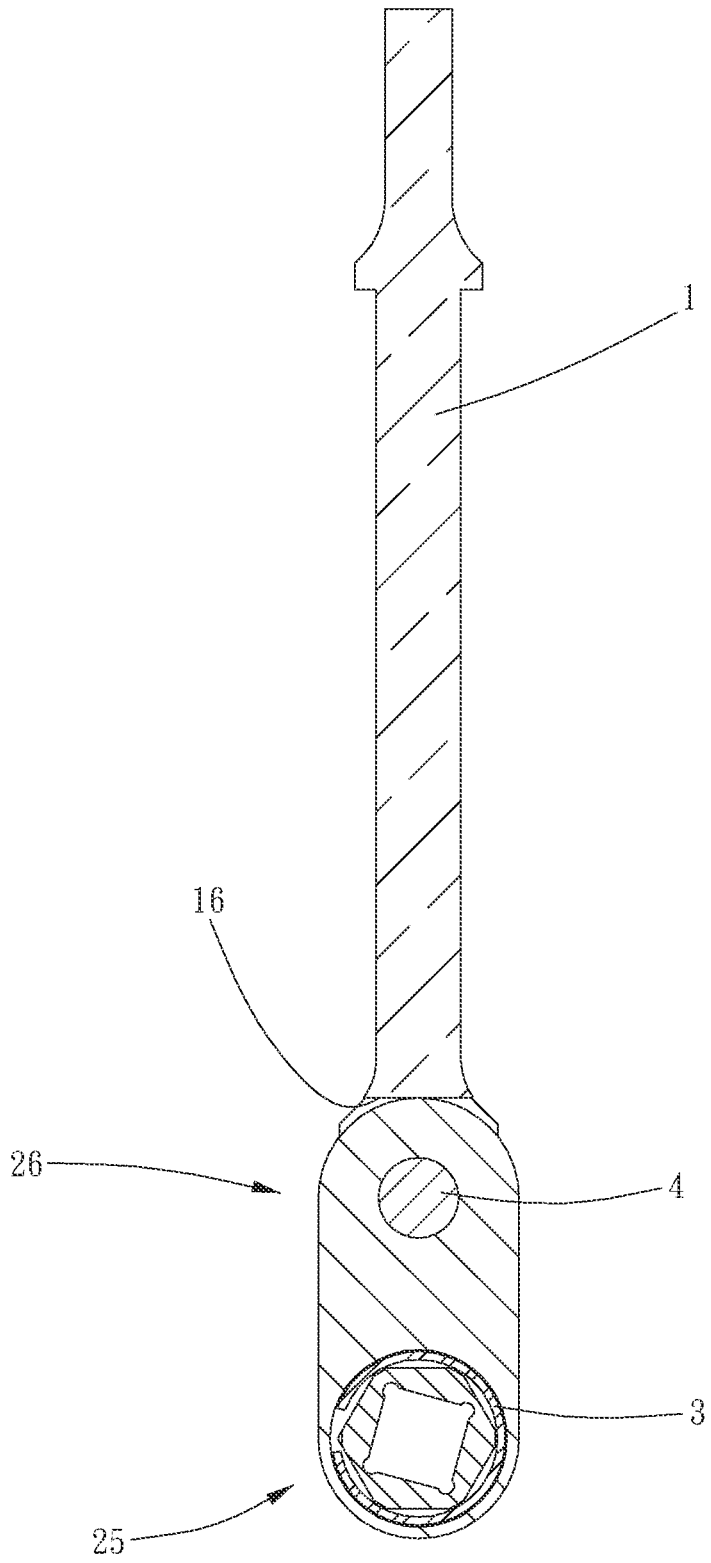
FIGS. 3 and 4 are cross-sectional views respectively showing different states of a driving member according to a preferable embodiment of the present invention.
Figure 4:
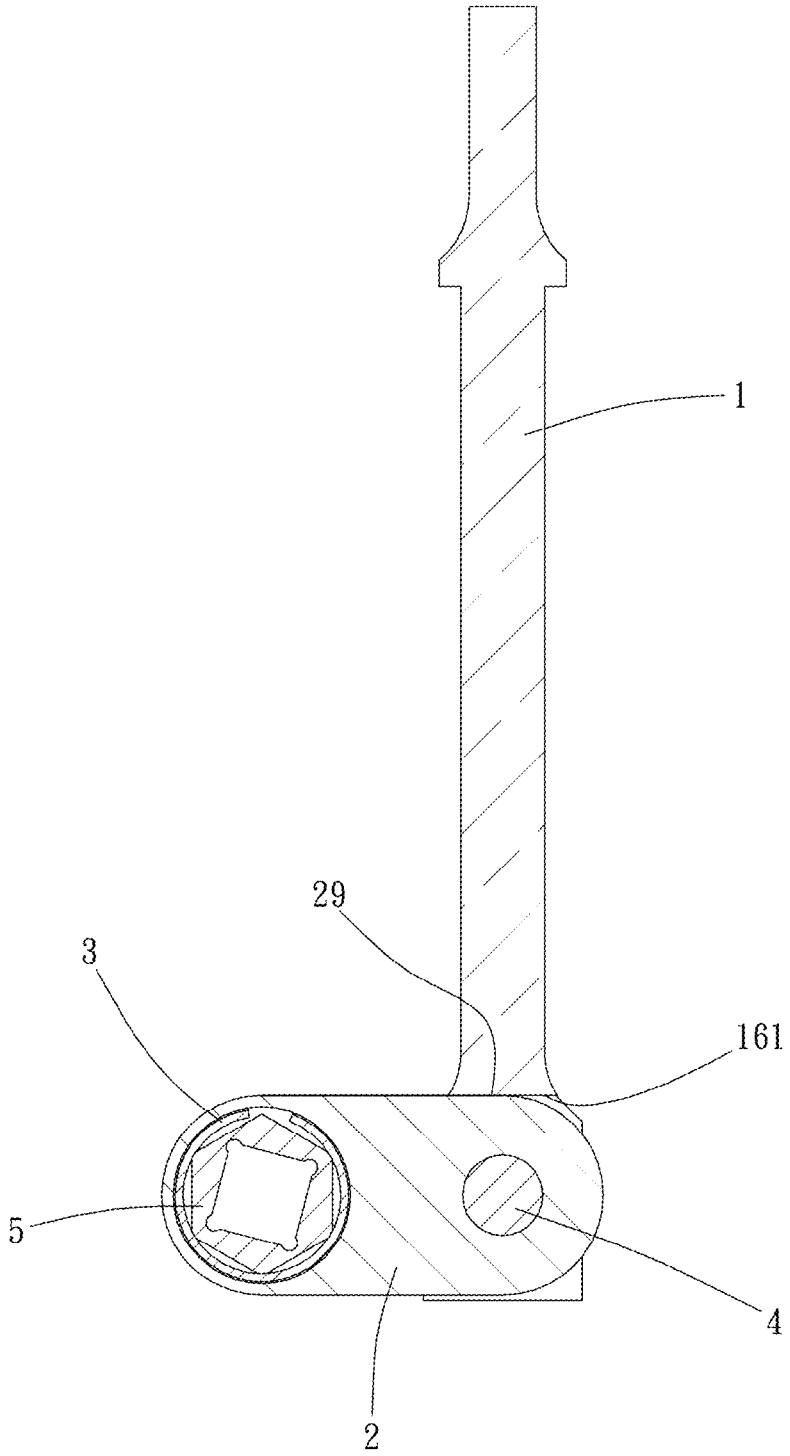
Figure 5:
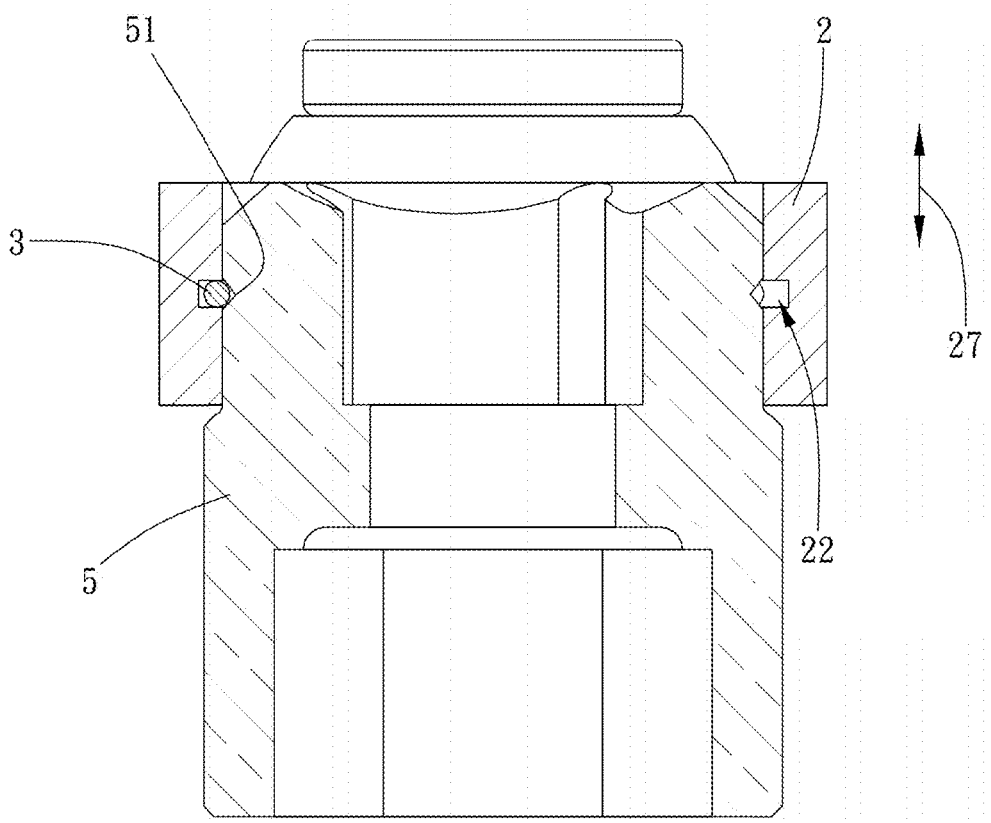
FIG. 5 is another cross-sectional view of a preferable embodiment of the present invention.
Figure 6:
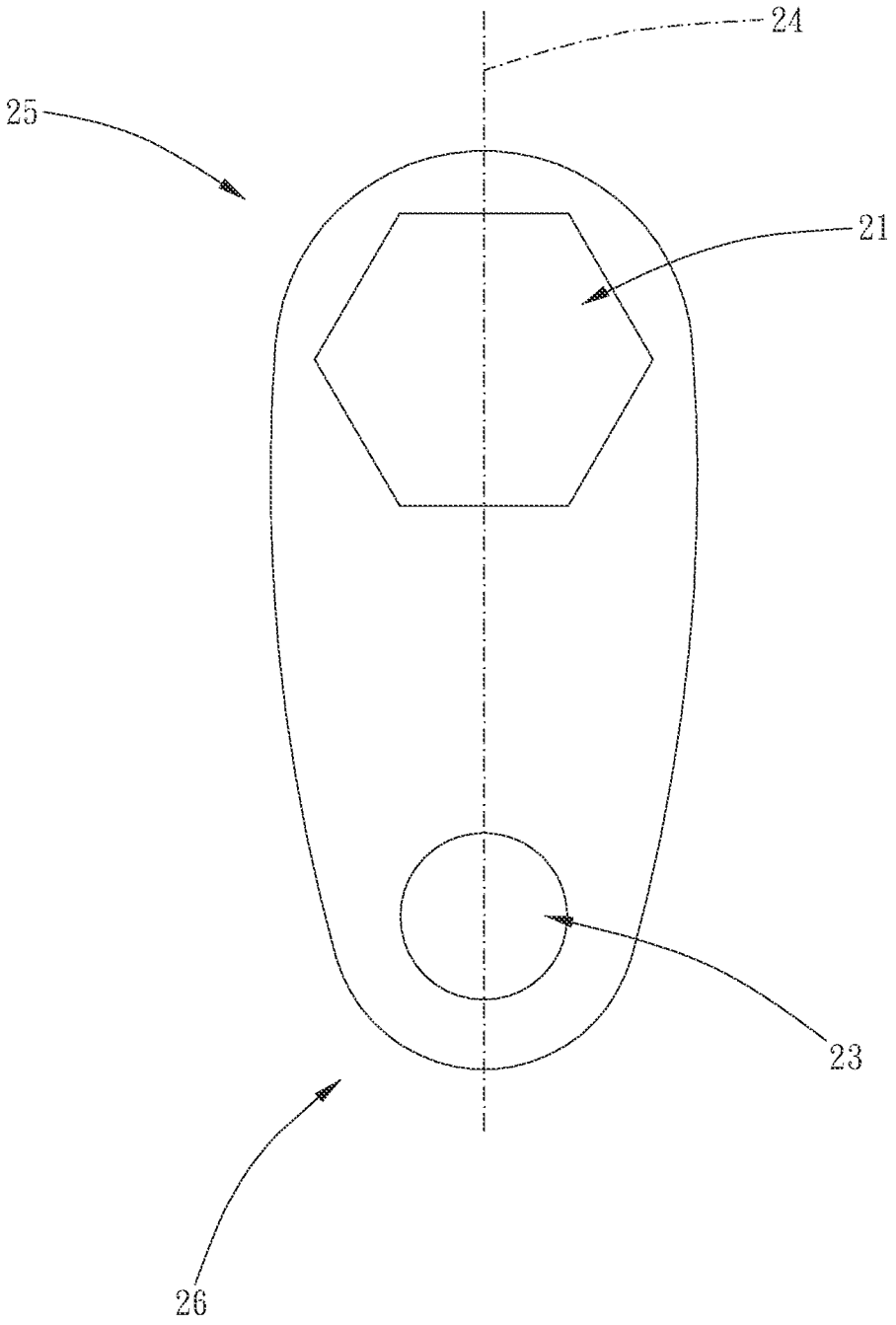
FIG. 6 is an enlargement of a driving member of a preferable embodiment of the present invention.

Please refer to FIGS. 1 to 6 for a preferable embodiment of the present invention. A wrench of the present invention includes a rod member 1 and a driving member 2.

The driving member 2 is rotatably connected to the rod member 1 to form a movable joint mechanism so that there are multiple use angles to meet requirements in different environments, such as removing the clutch nut in the engine room of a car. The driving member 2 is preferably plate-shaped, which increases contact area and swinging range. The driving member 2 includes an insertion hole 21, and the insertion hole 21 is configured for a connector 5 to be replaceably inserted therewithin depending upon various fasteners. The connector 5 may be a socket, extension rod, or the like.

The connector 5 is inserted within the insertion hole 21 of the driving member 2, which lowers their thickness and is easy to use in a narrow space. The driving member 2 having the insertion hole 21 is easy to manufacture, which lowers production cost and increases productivity.

Preferably, the insertion hole 21 is a regular polygonal hole, which can distribute force between the driving member 2 and the connector 5. In this embodiment, the insertion hole 21 is a hexagonal hole, which is compatible with most types of sockets.

Specifically, the driving member 2 further includes a circumferential wall 211 defining the insertion hole 21 and including an engaging groove 22, a restriction member 3 is engaged within the engaging groove 22, and the restriction member 3 is partially protrusive out from the engaging groove 22 to restrict the connector 5, which prevents disengagement of the connector 5 during operation. The restriction member 3 is meshed with at least one groove 51 of the connector 5.

Preferably, the brightness of the driving member 2 is higher than the brightness of the rod member 1 so that the driving member 2 can be saw easily as it is located within a narrow space.

The rod member 1 includes a first end 11 and a second end 14 on an axial direction thereof, the first end 11 is connected with the driving member 2, and the second end 14 includes a connection portion 15 for connection of a driving tool. In this embodiment, the connection portion 15 is configured to be connected to a pneumatic tool.

Specifically, the first end 11 of the rod member 1 includes two projections 12, the driving member 2 is inserted between the two projections 12, and a pin 4 connects the driving member 2 and the two projections 12 so that the driving a member 2 is rotatable about the pin 4.

Specifically, the first end 11 further includes a bottom portion 16, the bottom portion 16 is lateral to and connected between the two projections 12, and the driving member 2 is kept direct contacting the bottom portion 16 during rotating, wherein the bottom portion 16 keeps supporting the driving member 2 and the driving member 2 can be stably held relative to the rod member 1. When the driving member 2 rotates to be perpendicular to the rod member 1, a lateral surface 29 of the driving member 2 is abutted against an end surface 161 of the bottom portion 16.

In this embodiment, the driving member 2 further includes a connection hole 23, the pin 4 is disposed through the first end 11 of the rod member 1 and within the connection hole 23, a diametric dimension of the connection hole 23 is smaller than a diametric dimension of the insertion hole 21, and a center of the connection hole 23 and a center of the insertion hole 21 are located on an axis 24 of the driving member 2.

The driving member 2 further includes a driving side portion 25 and a connection side portion 26 on the axis, the connection side portion 26 includes the connection hole 23 disposed therethrough, and the driving side portion 25 includes the insertion hole 21 disposed therethrough.

A thicknesswise direction 27 is defined as to be perpendicular to the axis 24, a thickness of the driving side portion 25 is larger than a thickness of the connection side portion 26 in the thicknesswise direction 27. The thicknesswise direction 27 is parallel to an axis of the insertion hole 21. A shoulder portion 251 is formed between the driving side portion 25 and the connection side portion 26. The driving side portion 25 is thick, which provides strong structural strength for bearing the force from the connector 5 during rotating the fastener. The connection side portion 26 is thin and disposed between the two projections 12 between, which lowers the total thickness.

Preferably, a side of the first end 11 remote from the second end 14 includes an arcuate face 13. As collision to the rod member 1 occurs, the arcuate face 13 can prevent the rod member 1 from damage and it can operates smoothly. When the driving member 2 rotates to be perpendicular to the rod member 1, the arcuate face 13 is at least partially protrusive beyond the driving member 2 in the axial direction of the rod member.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A wrench, including:

a rod member; and a driving member, rotatably connected to the rod member, including an insertion hole disposed therethrough, the insertion hole being configured for a connector to be replaceably inserted therewithin;

wherein the rod member includes a first end including two projections, the driving member is inserted between the two projections, and a pin connects the driving member and the two projections;

wherein the first end further includes a bottom portion, the bottom portion is lateral to and connected between the two projections, and the driving member is kept direct contacting the bottom portion during rotating;

wherein when the driving member rotates to be perpendicular to the rod member, a lateral surface of the driving member is abutted against an end surface of the bottom portion.

2. The wrench of claim 1, wherein the rod member includes the first end and a second end on an axial direction thereof, the first end is connected with the driving member, and the second end includes a connection portion for connection of a driving tool.

3. The wrench of claim 1, wherein the driving member is rotatable about the pin.

4. The wrench of claim 1, wherein the driving member further includes a connection hole, the pin is disposed through the first end of the rod member and within the connection hole so that the driving member is rotatable about the pin; and a center of the connection hole and a center of the insertion hole are located on an axis of the driving member.

5. The wrench of claim 4, wherein the driving member includes a driving side portion and a connection side portion on the axis, the connection side portion includes the connection hole disposed therethrough, and the driving side portion includes the insertion hole disposed therethrough; a thicknesswise direction is defined as to be perpendicular to the axis, a thickness of the driving side portion is larger than a thickness of the connection side portion in the thicknesswise direction, and a shoulder portion is formed between the driving side portion and the connection side portion; wherein the thicknesswise direction is parallel to an axis of the insertion hole.

6. The wrench of claim 1, wherein the rod member includes the first end and a second end on an axial direction thereof, the driving member is disposed on the first end, a side of the first end remote from the second end includes an arcuate face; and when the driving member rotates to be perpendicular to the rod member, the arcuate face is at least partially protrusive beyond the driving member in the axial direction of the rod member.

7. The wrench of claim 1, wherein the insertion hole is a regular polygonal hole.

8. The wrench of claim 1, wherein the driving member further includes a circumferential wall defining the insertion hole and including an engaging groove, a restriction member is engaged within the engaging groove, and the restriction member is partially protrusive out from the engaging groove to restrict the connector; wherein the restriction member is meshed with at least one groove of the connector.

9. The wrench of claim 2, wherein the driving member is rotatable about the pin; the driving member further includes a connection hole, the pin is disposed through the first end of the rod member and within the connection hole so that the driving member is rotatable about the pin; and a center of the connection hole and a center of the insertion hole are located on an axis of the driving member; the driving member includes a driving side portion and a connection side portion on the axis, the connection side portion includes the connection hole disposed therethrough, and the driving side portion includes the insertion hole disposed therethrough; a thicknesswise direction is defined as to be perpendicular to the axis, a thickness of the driving side portion is larger than a thickness of the connection side portion in the thicknesswise direction; a side of the first end remote from the second end includes an arcuate face; and when the driving member rotates to be perpendicular to the rod member, the arcuate face is at least partially protrusive beyond the driving member in the axial direction of the rod member; the driving member further includes a circumferential wall defining the insertion hole and including an engaging groove, a restriction member is engaged within the engaging groove, and the restriction member is partially protrusive out from the engaging groove to restrict the connector; the insertion hole is a hexagonal hole; a diametric dimension of the connection hole is smaller than a diametric dimension of the insertion hole; a brightness of the driving member is higher than a brightness of the rod member; the driving member is plate-shaped; and the connection portion is configured to be connected to a pneumatic tool.

* * * * *